United States Patent [19]

Barkhult

[11] 4,393,589

[45] Jul. 19, 1983

[54] CONSTRUCTION FOR A MOTOR-DRIVEN CHAIN SAW

[75] Inventor: Bengt A. Barkhult, Hovås, Sweden

[73] Assignee: Emab Electrolux Motor Aktiebolag, Huskvarna, Sweden

[21] Appl. No.: 270,793

[22] Filed: Jun. 5, 1981

[30] Foreign Application Priority Data

Jun. 9, 1980 [SE] Sweden ..... 8004300

[51] Int. Cl.[3] ..... B27B 17/00

[52] U.S. Cl. ..... 30/381

[58] Field of Search ..... 30/381, 382, 383, 123.3, 30/384; 123/198 E, 195 C

[56] References Cited

U.S. PATENT DOCUMENTS 4,285,309 8/1981 Johansson ..... 30/383

*Primary Examiner*—Jimmy C. Peters

*Attorney, Agent, or Firm*—Alfred E. Miller

[57] ABSTRACT

A motor-driven chain saw having a plurality of units including an engine-saw unit, a casing, a multiplicity of fuel tanks, and filter elements for fuel and lubricant. The filter-tank unit is provided with a top portion and a bottom portion which restricts spacings for a direct location of the filter elements. The filter-tank unit is provided with a fixed pipe system for the fuel and lubricant between the spacings and the auxiliary apparatus constituting a carburetor and lubricant pump.

6 Claims, 4 Drawing Figures

CONSTRUCTION FOR A MOTOR-DRIVEN CHAIN SAW

The present invention relates to a filter and tank unit of a motor-driven chain saw and furthermore includes at least a housing or casing portion with handles.

It is known in chain saw design to use the principle of incorporating several functions into the design. It is therefore advantageous to isolate the motor and the chain saw unit from the rest of the structure by means of vibration reducing elements. A further step forward in the art is achieved in accordance with the present invention with reference to the filter and tank unit of a motor-driven chain saw. In this regard, the tank body is provided with a bottom portion and a top portion which enclose spaces for fuel and lubricant.

It is known in chain saw design to connect filter units for different media, such as air, fuel and oil with auxiliary apparatus such as the carburetor and pump. These interconnections are made by means of tubes. However, the present invention has the desirable technical effect of improving over the prior art structures in working safety, as well as reducing the number of parts, consequently lowering manufacturing costs.

In order that the invention will be more clearly understood, it will now be disclosed in greater detail with reference to the accompanying drawings, in which.

Figure 1:
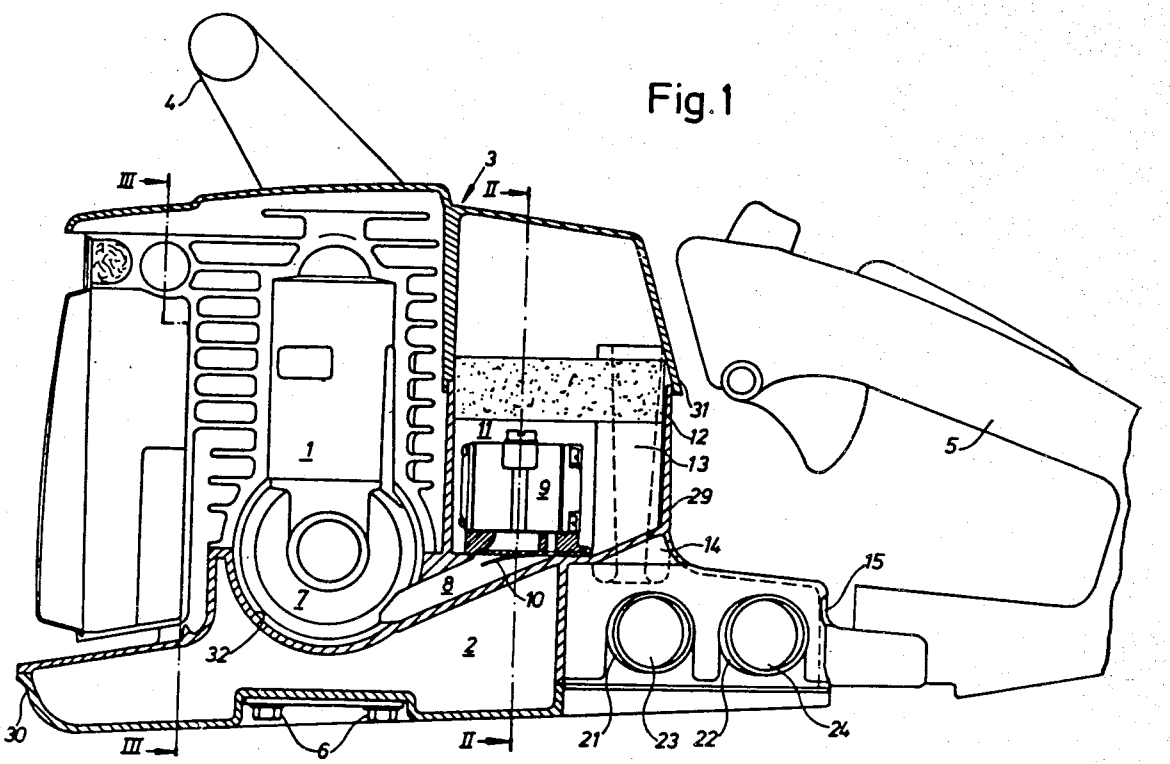
FIG. 1 is a vertical cross section of a motor-driven chain saw constructed in accordance with the teachings of the present invention, and on a reduced scale.
Figure 3:
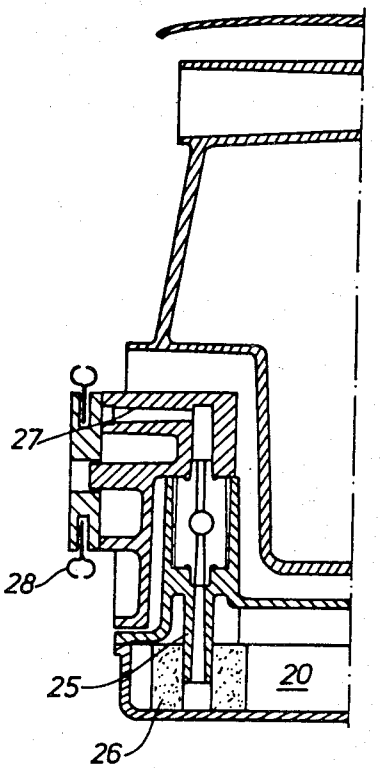
FIG. 3 is a sectional view taken along the lines 3—3 of FIG. 1, but on an enlarged scale.
Figure 2:
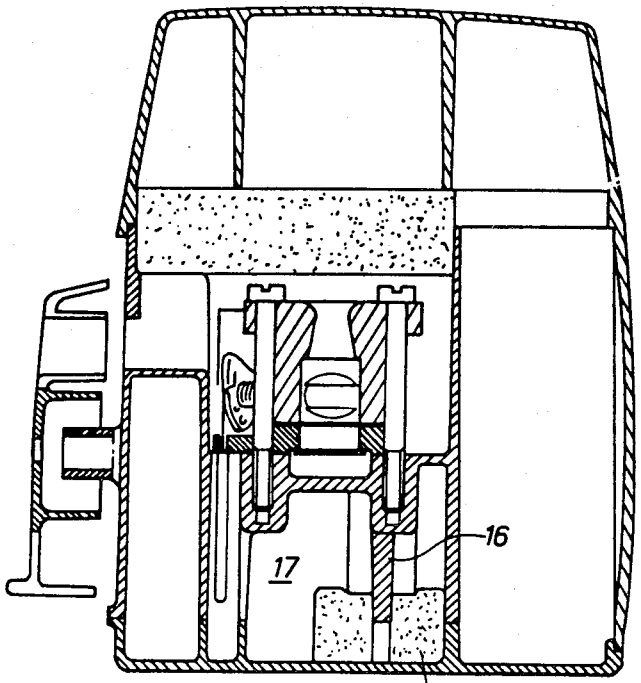
FIG. 2 is a vertical cross section taken along the lines 2—2 in FIG. 1, but on an enlarged scale.

FIGS. 1 and 2 show the overall construction of the motor-driven chain saw wherein the engine-saw attachment unit 1 is located in the center of the motor-saw housing. A filter-tank unit 2 is located below the engine-saw attachment. In addition, a casing 3 is provided with a front handle 4, as well as a rear handle 5. As seen in FIG. 1, the motor or engine is secured to the tank unit by means of screws 6 which penetrate holes in the tank unit and are fastened in threaded openings in the crank case 7. The latter communicates with a carburetor 9 by means of an intake manifold 8 provided with a reed valve 10. It should be evident that the carburetor 9 is secured to the bottom of a hole 11 in the tank unit 2, and is covered at the top of the hole by means of an air filter 12. Furthermore, the top of the filter communicates through a manifold 13 with an air intake space 14. As seen in FIG. 1 the air intake space has a hole 15 in its rear wall through which combustion air is taken in to the space. The present intake system as shown and described hereinbefore functions to protect the engine from pollution which envelopes the air around the saw when the latter is in use, and also serves as a silencer for the device.

Figure 4:
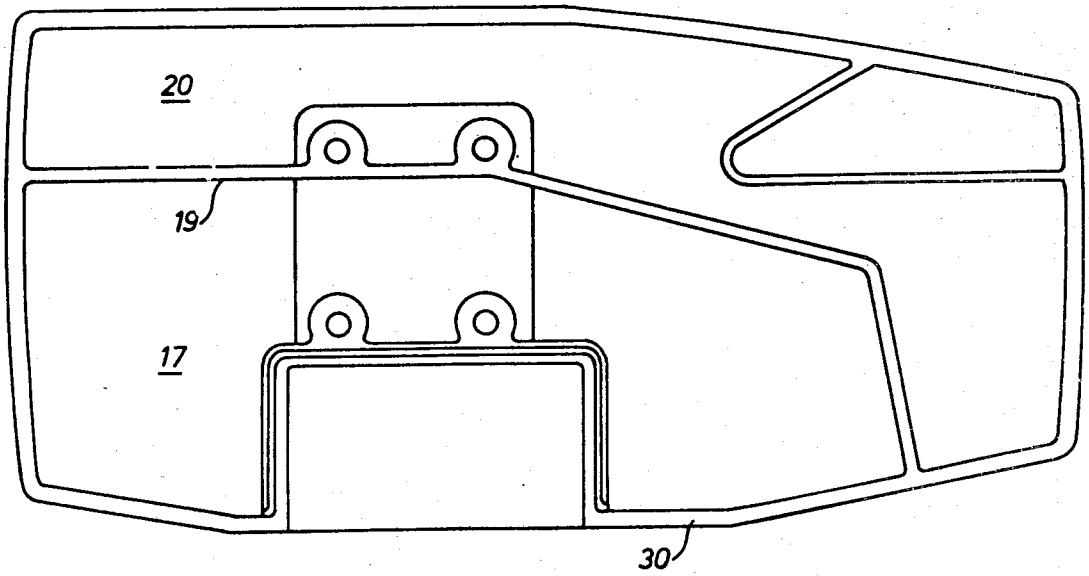
FIG. 4 is a bottom plan view of the bottom shell of the casing of the motor-driven chain saw.

Since the carburetor is attached to the tank unit it is possible to arrange a stationary connection for the fuel flow to the carburetor. This connection comprises a pipe 16, which projects into the fuel tank 17, and having its lower end inserted into a fuel filter 18 at the bottom of the tank, as seen in FIG. 2. The upper end of the pipe 16 connects directly to the intake valve (not shown) in the carburetor 9. The size and construction of the fuel tank unit 17 is shown in FIG. 4. As seen in that figure, the intermediate wall 19 separates the tank from the oil tank 20, the latter containing oil for the saw chain. As seen in FIG. 1, each of the tanks 17 and 19 has a filling hole 21 and 22 having a lid 23 and 24, respectively.

A connection is provided from the oil tank to the oil pump in order to lubricate the saw chain, when necessary. In this connection is a pipe 25 which projects into the oil tank and has its lower end inserted in an oil filter 26 at the bottom of the tank. The upper end of pipe 25 connects directly to the pump which is driven by a crank shaft by means of a worm gear (not shown). Furthermore, oil is forced from the pump through a manifold 27 to the top of the saw attachment in the track where the chain saw moves with a cutting action. Thus, both pipes 16 and 25 are directed to the top half 29 of the chain saw tank body, thus eliminating junctions and through-passages which may cause leakages.

The bottom part of the chain saw tank body 30 is shown in FIG. 4. This part is also a bottom portion of the saw body casing which is constituted of a shell 31 and side walls of the top half 29 to the tank body. The portions 29 and 30 are joined by means of gluing or welding so that the tanks 17 and 20, respectively are hermetically sealed. Adjacent to the hole 11, as seen in FIG. 1, there is a semi-cylindrical cavity 32 in the top part forming the loweer half of the crank case of the engine. Annexed to the cavity 32 recesses are provided for the crank shaft bearings.

It should be apparent that the present tank unit and associated stationary devices or apparatus, such as a carburetor, oil pump, permanent connections and filter attachments are substantially simplified in construction and arrangement. Thus, substantial cost savings in the manufacture of motor-driven chain saws are effected. This simplification results in a motor-driven chain saw which is extremely light in weight, yet is reliably effective for the purposes intended.

The present embodiment is an example of the invention, however it is evident that various changes in details and arrangements can be made within the spirit and scope of the present invention as defined in the following claims.

What is claimed is:

1. A chain saw having an oil pump and a carburetor comprising: a plurality of units including an engine-saw unit, a casing, a fuel tank, a fuel filter for said fuel tank forming a filter-tank unit, said filter-tank unit including a top portion and a bottom portion restricting spacings for oil and fuel, respectively, and enclosing said filter, a plurality of pipes molded and permanently mounted in said top portion for oil and fuel from the respective tanks to said oil pump and carburetor, said carburetor which is located on said top portion and is provided with an air filter, and a permanently formed and molded holder in said top portion for holding said filter.

2. A chain saw as claimed in claim 1 further comprising an oil pump located on said top portion.

3. A chain saw as claimed in claim 1 wherein said top portion is provided with a semi-cylindrical cavity constituting the lower half of the crank case of the engine.

4. A chain saw as claimed in claim 3 wherein said engine-saw unit and said filter-tank unit are joined by means of screws.

5. A chain saw as claimed in claim 1 wherein said casing is provided with front and rear handles, and said filter-tank unit constitutes an intermediate portion between the engine saw unit and said handles.

6. A chain saw as claimed in claim 4 further comprising an intake manifold in said top portion and disposed between said carburetor and said crank case.

* * * * *